US005220761A

United States Patent [19]

Selby

[11] Patent Number: 5,220,761

[45] Date of Patent: Jun. 22, 1993

[54] COMPOSITE CONCRETE ON COLD FORMED STEEL SECTION FLOOR SYSTEM

[76] Inventor: David A. Selby, 1785 Depatie St., St. Laurent, Quebec, Canada, H4L 4A7

[21] Appl. No.: 729,540

[22] Filed: Jul. 15, 1991

Related U.S. Application Data

[63] Continuation-in-part of Ser. No. 426,163, Oct. 25, 1989, abandoned.

[51] Int. Cl.[5] ..... E04B 1/16

[52] U.S. Cl. ..... 52/336; 52/732.1

[58] Field of Search ..... 52/334–336, 52/414, 738, 732, 452, 454, 93, 223 R, 225, 733

[56] References Cited

U.S. PATENT DOCUMENTS

| | | | |
|---|---|---|---|
| 611,366 | 9/1898 | Lund | 52/328 |
| 640,809 | 1/1900 | Rapp | 52/330 |
| 735,759 | 8/1903 | Guest | 403/387 |
| 810,001 | 1/1906 | Sullivan et al. | 52/738 |
| 1,057,658 | 4/1913 | Nichols | 403/391 |
| 1,073,542 | 9/1913 | Stewart | 52/336 |
| 1,174,452 | 3/1916 | Stewart | 52/326 |
| 1,300,994 | 4/1919 | Moise | 24/335 |
| 1,360,720 | 11/1920 | Brown et al. | 52/729 |
| 1,360,979 | 11/1920 | Stewart | 52/326 |
| 1,372,387 | 3/1921 | Badger | 52/681 |
| 1,541,917 | 6/1925 | Bowe | 240/205 |
| 1,597,278 | 8/1926 | Kahn | 52/237 |
| 1,652,056 | 12/1927 | Selway | 249/24 |
| 1,686,723 | 10/1928 | Lathrop | 52/341 |
| 1,898,736 | 2/1933 | Melvin | 52/335 |
| 1,936,147 | 11/1933 | Young | 52/356 |
| 1,986,690 | 1/1935 | Thomson | 52/250 |
| 2,020,407 | 11/1935 | Forster | 52/680 |
| 2,106,084 | 1/1938 | Condington | 52/702 |
| 2,246,578 | 6/1941 | Salardi | 72/200 |
| 2,271,592 | 2/1942 | Hilpert | 52/334 |
| 2,479,476 | 8/1949 | Cueni | 52/334 |
| 2,675,695 | 4/1954 | Coff | 52/225 |
| 2,933,917 | 4/1960 | Sampson | 52/454 |
| 3,010,257 | 11/1961 | Naillon | 52/225 |
| 3,017,600 | 1/1962 | Husted | 403/391 |
| 3,121,933 | 2/1964 | Dragunas | 249/23 |
| 3,141,532 | 7/1964 | Runyan | 52/105 |
| 3,165,815 | 1/1965 | Wogerbauer | 5/155 R |
| 3,177,619 | 4/1965 | Benjamin | 52/334 |
| 3,195,209 | 7/1965 | Klausner | 249/211 |
| 3,204,382 | 9/1965 | McGurn | 52/632 |
| 3,307,304 | 3/1967 | Klausner | 52/687 |
| 3,401,497 | 9/1968 | Gregory et al. | 52/733 |
| 3,564,799 | 2/1971 | Hanson | 52/454 |
| 3,604,167 | 9/1971 | Hays | 52/334 |
| 3,917,215 | 11/1975 | Fox et al. | 249/211 |
| 4,315,386 | 2/1982 | Clarke | 52/93 |
| 4,765,651 | 8/1988 | Unger | 74/89.14 |
| 4,885,884 | 12/1989 | Schilger | 52/356 |

FOREIGN PATENT DOCUMENTS

| | | | |
|---|---|---|---|
| 202332 | 8/1958 | Austria | 52/339 |
| 526409 | 6/1956 | Canada | 52/223 R |
| 602354 | 7/1960 | Canada | 52/632 |
| 828255 | 1/1952 | Fed. Rep. of Germany | 52/334 |
| 840435 | 6/1952 | Fed. Rep. of Germany | 52/632 |
| 2536442 | 5/1984 | France | 52/483 |
| 453694 | 12/1949 | Italy | 52/632 |

*Primary Examiner*—James L. Ridgill, Jr.
*Attorney, Agent, or Firm*—Thomas N. Neiman

[57] ABSTRACT

A floor system for residential and light commercial construction utilizing the composite action of a thin concrete slab and cold formed steel sections. A comparatively high load capacity is achieved with minimum floor thickness for short and medium spans. The composite action is achieved by a bond bar affixed to a cold formed section and embedded in the slab. A shear transfer device is attached to the bond bar and the cold formed steel section. The system may be used in buildings framed with masonry or concrete bearing walls, structural steel beams and girders, and precast, or cast in place, concrete beams and girders.

1 Claim, 3 Drawing Sheets

COMPOSITE CONCRETE ON COLD FORMED STEEL SECTION FLOOR SYSTEM

The is a continuation-in-part application of my copending application Ser. No. 07/426,163 originally filed on Oct. 25, 1989, now abandoned.

FIELD OF THE INVENTION

This invention pertains to a flooring system for light and medium loading on short and medium length spans. It utilizes concrete an cold formed steel in composite action.

BACKGROUND OF THE INVENTION

Flooring systems currently used in housing, commercial and light industry buildings are of light timber framing, concrete or combined concrete and structural steel. Light timber framing has serious disadvantages in respect to its combustible content, its high labor and material costs and its span limitations. The use of the open web timber joist attempts to overcome the span limitations but does so with considerable increase of overall floor thickness. Reinforced concrete floor systems have high load carrying capacity, are non-combustible but become excessively heavy in long span applications. In addition the cost of forming is excessive when limited repetition is involved. Precast concrete elements are useful for longer spans but require engineering and crane services to construct. Systems utilizing open web steel joists with a light metal deck to serve as the underside form for a cast in place floor slab are ideal for longer spans but are not economical for relatively short and intermediate spans. Housing contractors are often reluctant to utilize structural steel. The overall thickness of open web steel joist floor is also considerable.

Light timber framing is undesirable because of its combustibility and span limitation; total concrete systems have some advantages but some serious disadvantages. Existing combined concrete and steel systems similarly have some advantages and some disadvantages.

SUMMARY OF THE INVENTION

The floor system described herein utilizes the well known principle of composite action of cast in place concrete and structural steel. This involved the use of a thin wire meshed reinforced slab in composite action with cold formed steel sections. The necessary shear transfer is effected by the use of a continuous bond bar which is affixed to, but spaced from, the top flange of the cold formed section. The system includes arrangements for the underside forming of the concrete slab.

OBJECT OF THE INVENTION

Clearly, it is desirable for a system of this type to be very simple and flexible. At the same time, the system should be easy to install and, at the same time be very effective. It is the object of this invention, then to set forth an improved composite concrete on cold formed steel section floor system which avoid the disadvantages, limitations, above-recited, which obtain in prior flooring systems.

Particularly, it is the object of this invention to set forth a composite concrete on cold formed steel section floor system, for use in residential and light commercial construction having a composite support structure, comprising a concrete slab of uniform thickness; at least one primary support beam being uniformly spaced apart from other support beams when they are used and being positioned below said concrete slab; said beam comprising a cold formed steel channel section; each of said beams having a plurality of shear transfer means attached thereto above said beam and located at intermediate positions along said beam; said shear transfer means comprise inverted u-shaped blocks attached to said primary support beams; said shear transfer means comprise means that transfers accumlated incremental flexural compression force from said concrete slab; by direct concrete compression on the solid faces of said u-shaped block and by transfer of the incremental shear force accumulated in the superior located bond bar; a bond bar positioned above and attached to said shear transfer means for being embedded within said uniform slab of concrete in order to provide a shear accumulator function for said bond bar; and said bond bar comprises a continuous shear collecting rod positioned parallel over each of said primary support beams.

Also, it is the object of this invention to teach a composite concrete on cold formed steel section floor system, for use in residential and light commercial construction having a composite support structure, comprising a variable thickness slab of concrete; at least one primary support beam being uniformly spaced apart from other support beams when they are used and being positioned below said concrete slab; said beam comprising a cold formed steel channel section; each of said beams having a plurality of shear transfer means attached thereto above said beam and located at intermediate positions along said beam; said shear transfer means comprise inverted u-shaped blocks attached to said primary support beams; and said shear transfer means further comprising means that transfer accumulated incremental flexural compression force from said concrete by direct concrete compression on the solid faces of said u-shaped blocks and by transfer of the incremental shear force accumulated in the superior located bond bars; a bond bar positioned above and attached to said shear transfer means for being imbedded within said variable thickness slab of concrete in order to provide a shear accumulated function for said bond bar; said bond bar comprising a continuous shear collecting rod positioned parallel over each of said primary support beams.

Further objects and features of this invention will become more apparent by reference to the following description taken in conjunction with the accompanying figure, in which.

Figure 1:
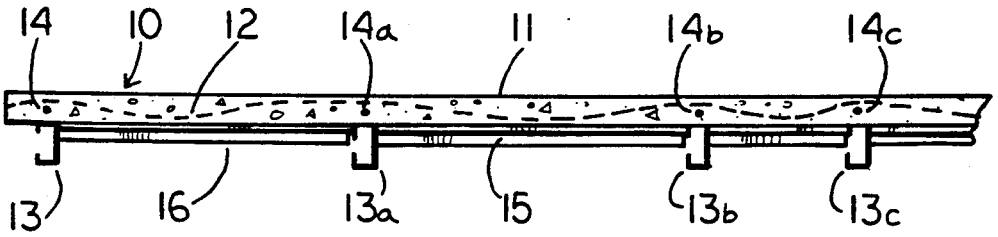
FIG. 1 is a cross section normal to the span of the cold formed elements.
Figure 2:
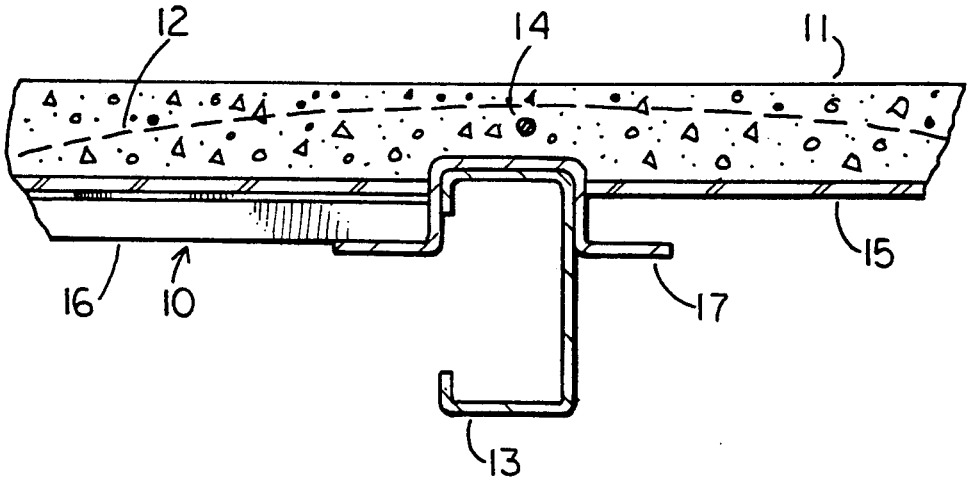
FIG. 2 is an enlarged cross section of the arrangement at a cold formed section.
Figure 3:
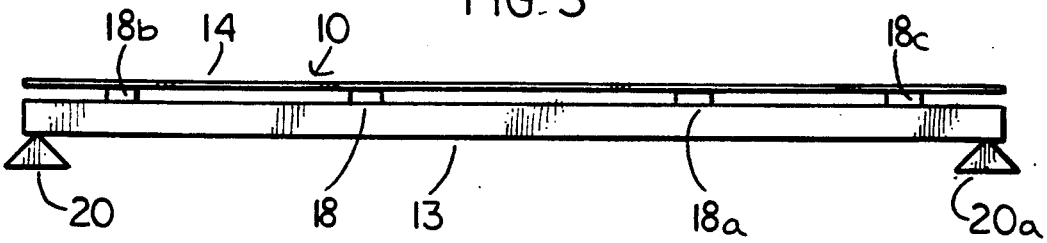
FIG. 3 is a side elevational view of a cold formed section with the bond bar attached.

As shown in the figures, the novel floor system 10 is comprised of a concrete slab 11 which contains a wire mesh 12 which functions as the transverse reinforcing unit and as a longitudinal shrinkage reinforcing unit. The cold formed section 13 through 13*d* comprises a steel channel beam and functions as the tension flange in conjunction with the compression flange comprised by the concrete slab 11. The necessary shear flow is gathered by the bond bar 14 through 14*c* and transferred intermittently to the top flange of the cold formed section 13. The soffit form 15 through 15*c* is a standard waferboard or plywood sheet. This soffit form supports the freshly poured concrete by bearing upon the soffit form support pieces 16. These soffit support pieces may, for example, consist of inverted top hat cold formed sections. The wire mesh 12 is draped over the bond bar 14 and then allowed to sag to the bottom part of the slab 11 mid span. The soffit form support piece 16 bears upon a saddle 17 which is placed loose on top of the cold formed beam section, alternately a temporarily bolted clamp (not shown) may be placed on the bottom flange. The theoretical composite action of the concrete slab in compression and the cold formed steel channel section acting in tension is achieved by the transfer of the horizontal shear flow between the concrete slab 11 and the cold formed section 13. This transfer starts with the transfer of incremental compression force from the slab 11 to the bond bar 14 throughout its length and its transfer at the intermittent points from the bond bar 14 to the cold formed section 13. The interior shear transfer devices 18 through 18*c* connect the bond bar 14 to the cold formed section 13. The cold formed section 13 is supported by end reactions 20 and 20*a*. The bond bar 14 consists of a suitable sized ordinary deformed reinforcing bar. The number of interior shear transfer devices 18 through 18*c* are dependent upon the total shear flow to be transferred, which in turn is dependent on the load and the span.

Figure 4:
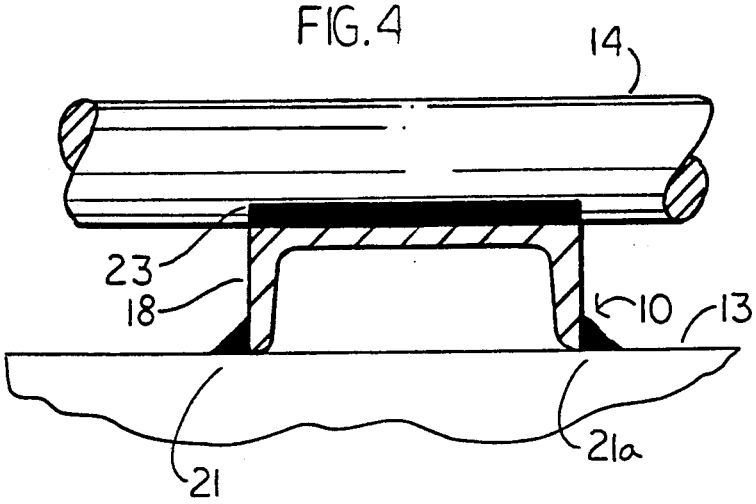
FIG. 4 is an enlarged side elevational view of the welded shear transfer device.

FIG. 4 is an enlarged side elevational view of the welded shear transfer device. Said shear transfer means comprise inverted u-shaped blocks 18 having a flat upper surface and two downward and perpendicular projecting legs, and said inverted u-shaped blocks are oriented to have their opposing open ends facing transverse to the direction of the length of the primary support beam 13, and said inverted u-shaped blocks having a length transverse to the support beam that is equal to the full width of the flat portion of the said primary beams flange and said inverted u-shaped block having thereby solid faces which are perpendicular to the top flange of the primary beam and transverse to it, and said inverted u-shaped blocks having a dimension in the direction of the primary beams length that is more or less equal to its dimension transverse thereto, and said u-shaped blocks being welded to the said primary beams by welds 21 and 21*a* located along the lower edge of the exterior solid faces of the two legs of the said inverted u-shaped block, and said welds continuing for the full width of the flat portion of the primary beams flange, aaid shear transfer means thereby providing means for the transfer of direct compression force from the concrete slab by direct and perpendicular concrete bearing on the full area of the vertical exterior faces of the inverter u-shaped blocks and said shear transfer means having a flat superior surface of substantially square shape which permits welding thereto of; a bond bar 14 which is continuous for the full length of the primary beam and is parallel thereto, and said bond bar is embedded in the concrete slab and is located in the concrete slab and is located in an absolutely superior position with respect to the said shear transfer means and is connected thereto for its full strength by longitudinal welds 23 placed on each side thereof and running for the full length contiguous with the said shear transfer means, said bond bar comprises a continuous accumulator of incremental flexural compression force received from said concrete slab and which is transferred by the shear transfer means to the said primary beam.

Figure 5:
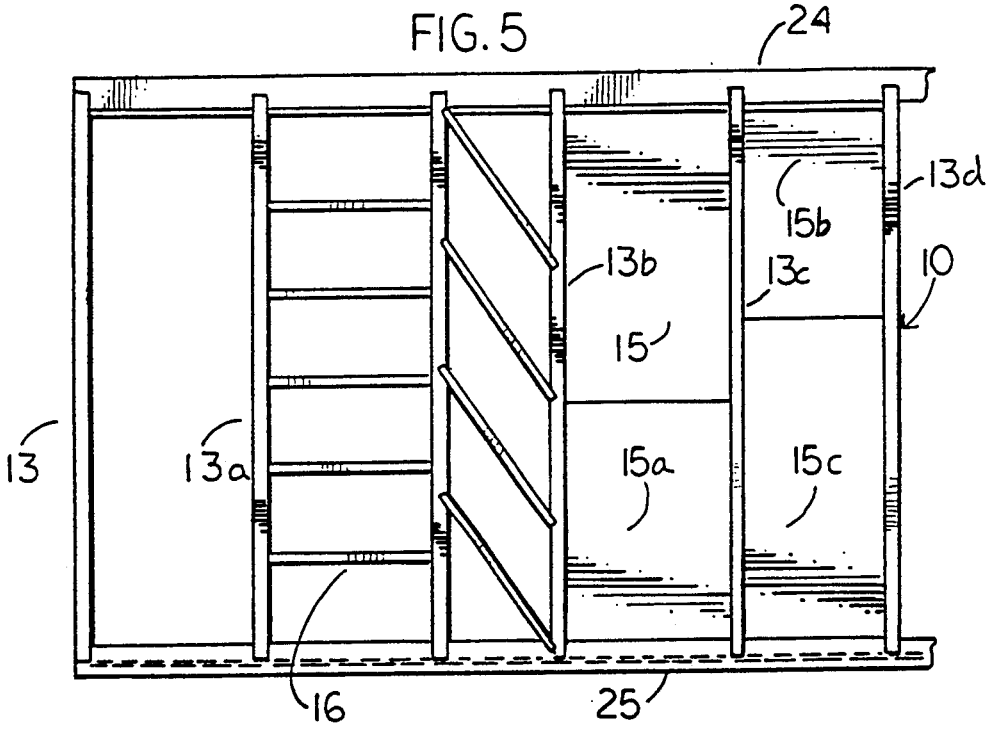
FIG. 5 is a small scale top plan view of the forming system.

FIG. 5 is a plan view on a small scale illustrating the arrangement of the form system prior to the placing of concrete. The cold formed sections are supported on a poured concrete or concrete block wall sections 24 and a steel beam 25, for example. The cold formed section 13 are spaced apart to have a clear inside dimension slightly greater than the width of a standard waferboard or plywood sheet 15 which acts as the soffit form for the concrete slab. Spaces less than the standard sheet size are made up from cut sheets. The soffit form is in turn supported by the soffit support pieces. In the case of the space between cold formed sections being less than the standard sheet width the soffit form support pieces are sized to fit.

Figure 6:
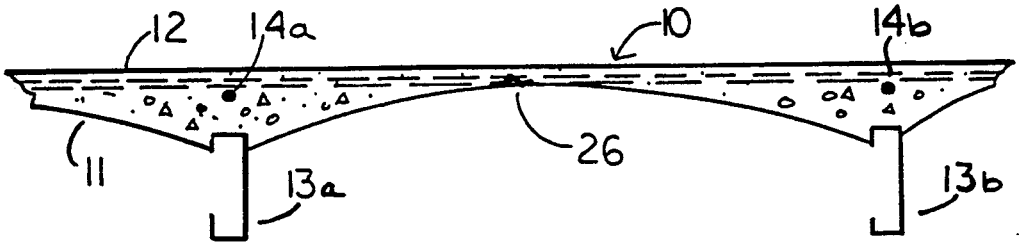
FIG. 6 is a cross sectional view of a floor in which the concrete slab has an increased thickness in the proximity of the cold formed section.
Figure 7:
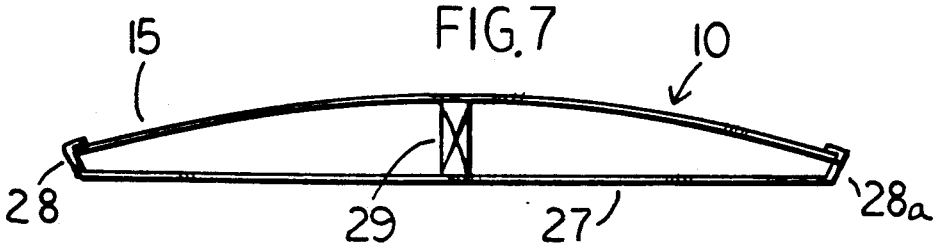
FIG. 7 is a cross sectional view of the soffit form used in the thickened slab arrangement.

The alternate arrangement for the system is shown in FIGS. 6 and 7. This figure shows a slab 11 that has an increased depth adjacent to and above the cold formed section. This increases the shear capacity of the slab in its transverse action thereby increasing the distributed load strength. It also greatly increases the flexural strength of the composite section in a longitudinal action, thus permitting the use of longer span. Also shown is a continuous chair 26 which is used to retain the wire mesh in a predetermined location. The wire mesh passes above and is tied to the bond bar and then is supported and tied down to the chair 26 which in turn is tied to the soffit form. The waferboard or plywood is arched into the desired shape by the cold formed steel tie 27. The plywood is retained at its edges by end pieces 28 and 28*a*. A continuous center block 29 is used to stabilize the arched soffit form under construction loads.

Figure 8:
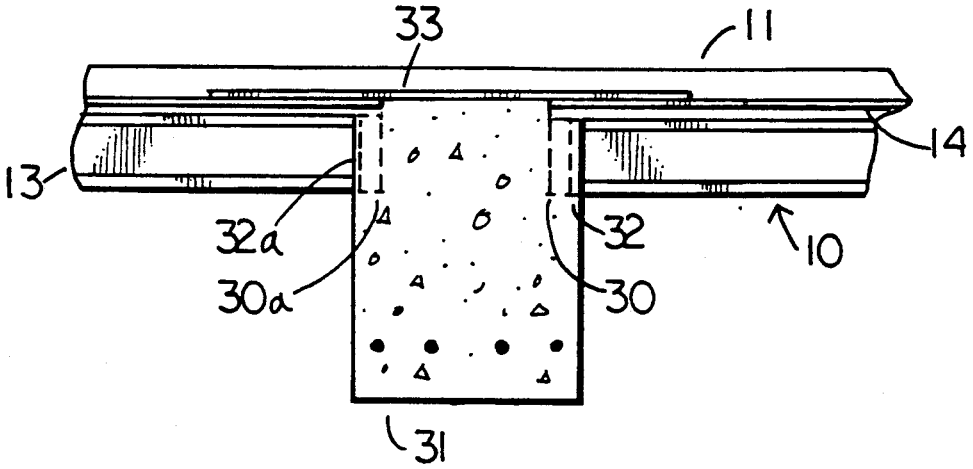
FIG. 8 is a sectional view showing the end of a cold formed section embedded in a cast in place concrete beam.
Figure 9:
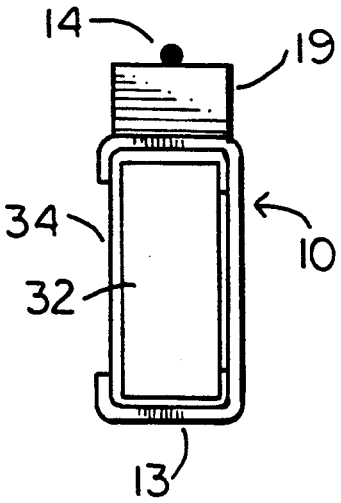
FIG. 9 is a large scale cross sectional view showing the end bearing reinforcement of the cold formed section.

It is also possible to use the flooring system in a concrete frame building in which the major beams are either precast or cast in place. Such an arrangement is shown in FIG. 8. The cold formed channels 13 would have their ends 30 and 30*a* set into the side forms of the beam 31. The cold formed channels 13 would have an internal stiffener 32 and 32*a* which serves as a bulkhead to contain the freshly poured concrete. A splice bar 33 would lap the bond bars 14 to provide continuity over the beam 31. FIG. 9 illustrates an arrangement in which the combination end stiffener and bulkhead 32 is installed in the end of a cold formed channel 13. The cold formed section 34 is shaped to be tightly internally fitting to the cold formed channel 13. An extension of its web is bent to serve as the combination stiffener bulkhead 32. The cold formed section piece 34 is inserted in the cold formed channel 13 so that the open side of the piece 34 is adjacent to the web side of the cold formed channel 13.

While I have described my invention in connection with specific embodiments thereof, it is clearly to be understood that this is done only by way of example and not as a limitation to the scope of my invention as set forth in the objects thereof and in the appended claims.

I claim:

1. A composite concrete on cold formed steel section floor system, for use in residential and light commercial construction having a composite support structure, comprising:

a concrete slab of uniform thickness;

at least one primary support beam being uniformly spaced apart from other support beams when they are used and being positioned below said concrete slab;

said beam comprising a cold formed steel channel section:

each of said beams having a plurality of shear transfer means attached thereto above said beam and located at intermediate positions along said beam;

said shear transfer means comprise inverted U-shaped blocks attached to said primary support beams by welding for the purpose of providing means that transfers both direct concrete bearing compression force and accumulated incremental flexural compression force from said concrete slab;

said inverted U-shaped blocks having a flat upper surface and two downward and perpendicular projecting legs;

said inverted U-shaped blocks having opposing open ends facing transverse to the direction of the length of the primary support beam;

said inverted U-shaped blocks having a length transverse to the support beam that is equal to the full width of said flat portion of said primary beams flange which results in said u-shaped block having a solid face perpendicular to the top flange of said primary beam and transverse to it;

said inverted U-shaped blocks further having a dimension in the direction of said primary beam's length that is approximately equal to its dimension transverse thereto;

said inverted U-shaped blocks further being welded to said primary support beams by welds located along the lower edge of said exterior solid faces of said two legs of said inverted u-shaped block and said welds continuing for the full width of said flat portion of said primary support beams flange in order to provide for the transfer of direct compression force from said concrete slab by direct and perpendicular concrete bearing on the full area of the vertical exterior faces of said inverted u-shaped blocks;

a bond bar comprising a continuous rod for the full length of said primary support beam and is parallel thereto, embedded in said concrete slab and located in a superior position with respect to said shear transfer means, and being connected thereto for its full strength by longitudinal welds placed on each side thereof and running for the full length contiguous with said shear transfer means; and said bond bar comprising a continuous accumulator of incremental flexural compression force received from said concrete slab and which is transferred by the shear transfer means to said primary beam.

* * * * *